US010352313B2

(12) United States Patent
Ha et al.

(10) Patent No.: US 10,352,313 B2
(45) Date of Patent: Jul. 16, 2019

(54) LINEAR COMPRESSOR

(71) Applicant: LG ELECTRONICS INC., Seoul (KR)

(72) Inventors: Seongho Ha, Seoul (KR); Donghan Kim, Seoul (KR); Kwangwoon Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 337 days.

(21) Appl. No.: 14/644,254

(22) Filed: Mar. 11, 2015

(65) Prior Publication Data

US 2015/0369225 A1 Dec. 24, 2015

(30) Foreign Application Priority Data

Jun. 24, 2014 (KR) ..... 10-2014-0077505

(51) Int. Cl.
*F04B 35/04* (2006.01)
*F04B 39/12* (2006.01)
(Continued)

(52) U.S. Cl.
CPC ..... *F04B 39/122* (2013.01); *F04B 35/045* (2013.01); *F04B 39/123* (2013.01);
(Continued)

(58) Field of Classification Search
CPC ..... F04B 17/046; F04B 35/045; F04B 53/20; F04B 53/008; F04B 39/0005;
(Continued)

(56) References Cited

U.S. PATENT DOCUMENTS 2,907,304 A 4/1957 Macks
3,777,722 A * 12/1973 Lenger ..... F04B 31/00 123/193.2
(Continued)

FOREIGN PATENT DOCUMENTS

CN 102374208 3/2012
EP 2 568 173 3/2013
(Continued)

OTHER PUBLICATIONS

Chinese Office Action dated Dec. 23, 2016.
European Search Report dated Nov. 16, 2015.

*Primary Examiner* — Alexander B Comley
(74) *Attorney, Agent, or Firm* — Ked & Associates LLP

(57) ABSTRACT

A linear compressor is provided that may include a shell including a suction inlet, a cylinder provided in the shell to define a compression space for a refrigerant, a piston reciprocated in an axial direction within the cylinder, a discharge valve provided at a first side of the cylinder to selectively discharge the refrigerant compressed in the compression space, at least one nozzle, through which at least a portion of the refrigerant discharged through the discharge valve flows, the at least one nozzle being disposed in the cylinder, and at least one expansion portion that extends from the at least one nozzle to an inner circumferential surface of the cylinder, the at least one expansion portion having a flow cross-section area greater than a flow cross-section area of the at least one nozzle.

10 Claims, 14 Drawing Sheets

(51) Int. Cl.
*F04B 53/00* (2006.01)
*F04B 53/16* (2006.01)
*F04B 53/20* (2006.01)

(52) U.S. Cl.
CPC ..... *F04B 39/126* (2013.01); *F04B 53/008* (2013.01); *F04B 53/20* (2013.01); *F04B 53/162* (2013.01)

(58) Field of Classification Search
CPC ... F04B 39/0292; F04B 39/121–39/126; F04B 39/16
USPC ..... 417/417, 415; 384/12; 92/169.1
See application file for complete search history.

(56) References Cited

U.S. PATENT DOCUMENTS 5,525,845 A * 6/1996 Beale ..... F02G 1/0435 310/12.27
6,742,998 B2 * 6/2004 Kawahara ..... F04B 35/045 417/363
8,398,752 B2 * 3/2013 Brownstein ..... B01D 39/1623 28/107
8,601,935 B2 * 12/2013 Giacchi ..... F04B 35/045 92/153
8,714,075 B2 * 5/2014 Giacchi ..... B23K 26/0626 92/169.1
2006/0147130 A1 * 7/2006 Ruijl ..... F16C 29/025 384/12
2008/0008610 A1 * 1/2008 Muth ..... F04B 35/045 417/416
2009/0238701 A1 * 9/2009 Giacchi ..... F04B 39/16 417/321
2009/0301293 A1 * 12/2009 Bechtold ..... F04B 35/045 92/127
2010/0154441 A1 * 6/2010 Schubert ..... F04B 35/045 62/56
2010/0229717 A1 * 9/2010 Schubert ..... F04B 35/045 92/170.1
2013/0058815 A1 * 3/2013 Kim ..... F04B 35/045 417/437

FOREIGN PATENT DOCUMENTS

KR 10-1307688 B1 9/2013
WO WO 2013/071382 5/2013
WO WO 2013071382 A2 * 5/2013 ..... F04B 35/045

* cited by examiner

LINEAR COMPRESSOR

CROSS-REFERENCE TO RELATED APPLICATION(S)

This application claims priority under 35 U.S.C. § 119 to Korean Application No. 10-2014-0077505, filed in Korea on Jun. 24, 2014, whose entire disclosure is hereby incorporated by reference.

BACKGROUND

1. Field

A linear compressor is disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. The cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors, in which a compression space into and from which a working gas is suctioned and discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas; while the orbiting scroll rotates along the fixed scroll. In recent years, a linear compressor, which is directly connected to a drive motor and in which a piston is linearly reciprocated, to improve compression efficiency without mechanical losses due to movement conversion and having simple structure, is being widely developed. The linear compressor may suction and compress a working gas, such as a refrigerant, while the piston is linearly reciprocated in a sealed shell by a linear motor and then discharge the refrigerant.

The linear motor is configured to allow a permanent magnet to be disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the piston may suction and compress the refrigerant while being linearly reciprocated within the cylinder and then discharge the refrigerant.

The present Applicant filed for a patent (hereinafter, referred to as a "prior document") and then registered the patent with respect to the linear compressor, as Korean Patent No. 10-1307688, filed in Korea on Sep. 5, 2013, and entitled "linear compressor", which is hereby incorporated by reference.

The linear compressor according to the prior art document includes a shell to accommodate a plurality of components. A vertical height of the shell may be somewhat high, as illustrated in FIG. 2 of the prior art document. An oil supply assembly to supply oil between a cylinder and a piston may be disposed within the shell. When the linear compressor is provided in a refrigerator, the linear compressor may be disposed in a machine chamber provided at a rear side of the refrigerator.

In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor in the prior art document is not applicable to a refrigerator for which an inner storage space having an increased size is sought.

To reduce the size of the linear compressor, it may be necessary to reduce a size of a main component of the compressor. In this case, the compressor may deteriorate in performance.

To compensate for the deteriorated performance of the compressor, it may be necessary to increase a drive frequency of the compressor. However, the more the drive frequency of the compressor is increased, the more a friction force due to oil circulating in the compressor increases, deteriorating performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
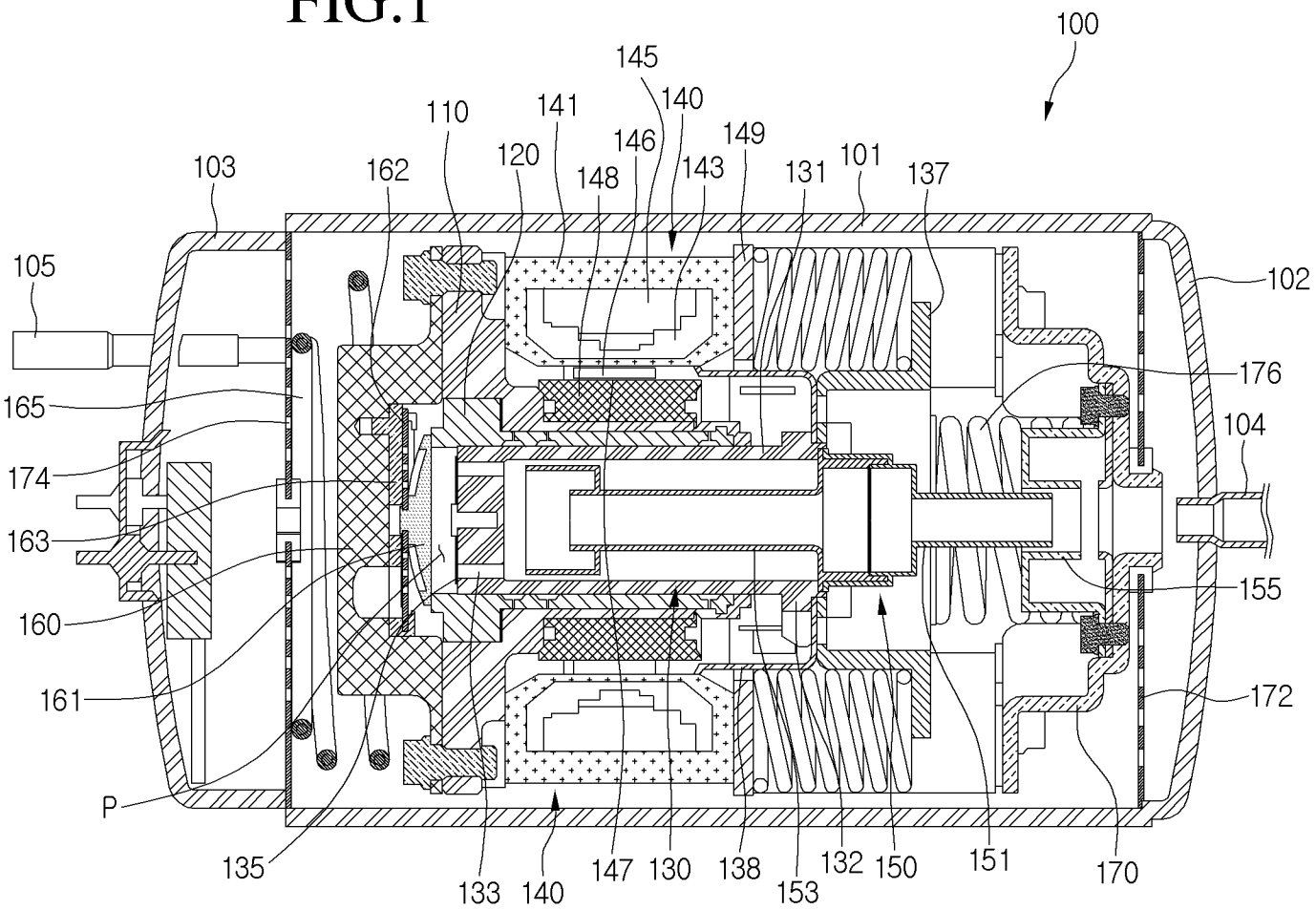
FIG. 1 is a cross-sectional view of a linear compressor according to an embodiment.

FIG. 1 is a cross-sectional view of a linear compressor according to an embodiment. Referring to FIG. 1, the linear compressor 100 according to an embodiment may include a shell 101 having an approximately cylindrical shape, a first cover 102 coupled to a first side of the shell 101, and a second cover 103 coupled to a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101, with reference to FIG. 1. Each of the first and second covers 102 and 103 may be understood as one component of the shell 101.

The linear compressor 100 may further include a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate. The linear compressor 100 according to this embodiment may have a drive frequency of about 100 Hz, for example.

The linear compressor 100 may include a suction inlet 104, through which the refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. Thus, while the refrigerant passes through the suction muffler 150, noise may be reduced. The suction muffler 150 may include a first muffler 151 coupled to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a nonmagnetic material, such as an aluminum material, such as aluminum or an aluminum alloy. As the piston 130 may be formed of the aluminum material, a magnetic flux generated in the motor assembly 140 may not be transmitted to the piston 130, and thus, may be prevented from leaking outside of the piston 130. The piston 130 may be manufactured by a forging process, for example.

The cylinder 120 may be formed of a nonmagnetic material, such as an aluminum material, such as aluminum or an aluminum alloy. The cylinder 120 and the piston 130 may have a same material composition, that is, a same kind of material and composition.

As the cylinder 120 may be formed of the aluminum material, a magnetic flux generated in the motor assembly 140 may not be transmitted to the cylinder 120, and thus, may be prevented from leaking outside of the cylinder 120. The cylinder 120 may be manufactured by an extruding rod processing process, for example.

As the piston 130 may be formed of the same material as the cylinder 120, the piston 130 may have a same thermal expansion coefficient as the cylinder 120. When the linear compressor 100 operates, a high-temperature (a temperature of about 100° C.) environment may be created within the shell 100. Thus, as the piston 130 and the cylinder 120 may have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 130 moves.

The cylinder 120 may be configured to accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P, and a discharge valve assembly 161, 162, and 163 coupled to the discharge cover 160 to selectively discharge the refrigerant compressed in the compression space P may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 to restrict deformation of the valve spring 162.

The term "compression space P" may refer to a space defined between the suction valve 135 and the discharge valve 161. The suction valve 135 may be disposed at a first side of the compression space P, and the discharge valve 161 maybe disposed at a second side of the compression space P, that is, a side opposite of the suction valve 135.

Figure 3:
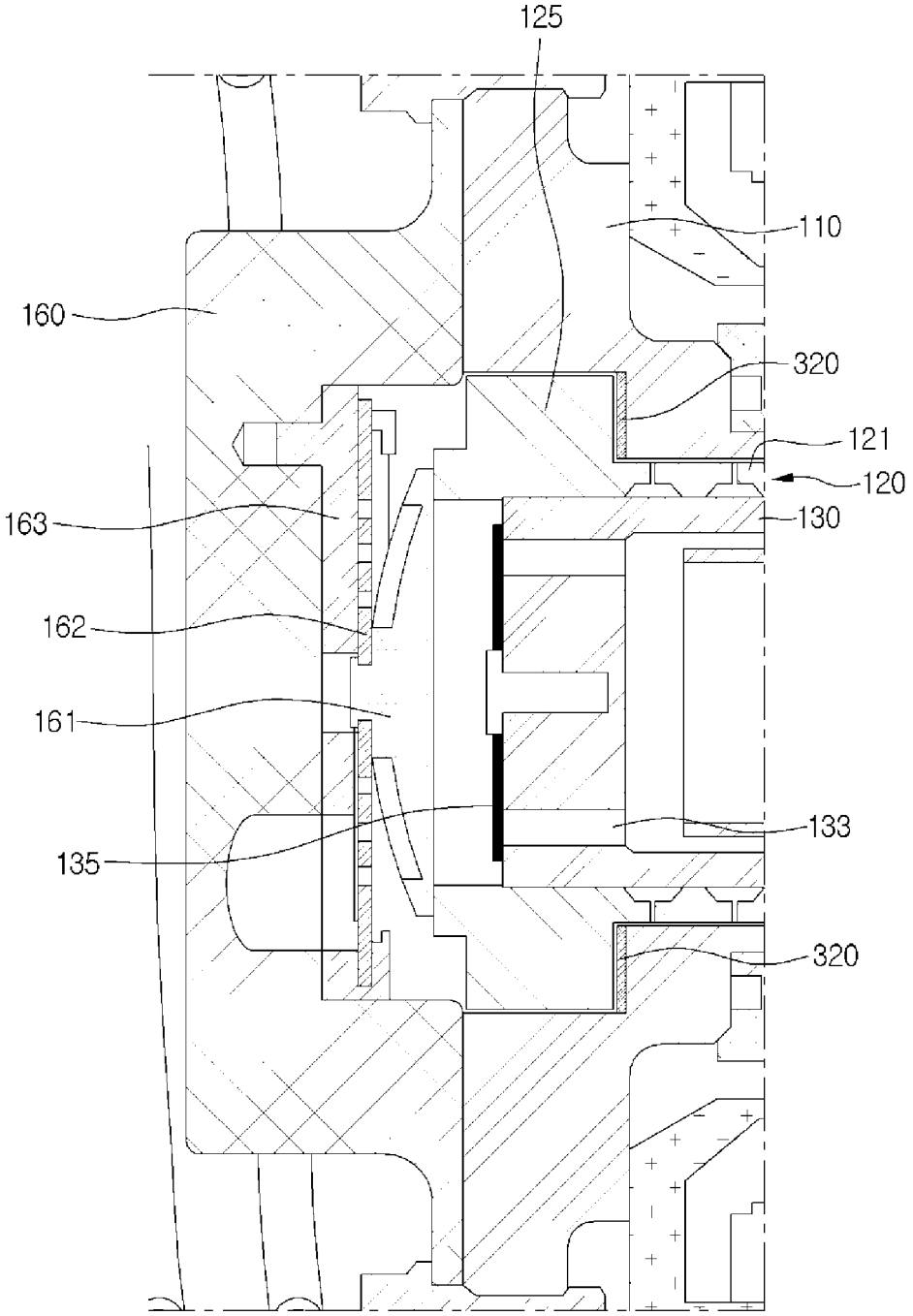
FIG. 3 is a partial cross-sectional view of the linear compressor of FIG. 1, illustrating a position of a second filter.

The term "axial direction" may refer to a direction in which the piston 130 is reciprocated, that is, a transverse direction in FIG. 3. Also, in the axial direction, a direction from the suction inlet 104 toward the discharge outlet 105, that is, a direction in which the refrigerant flows may be defined as a "frontward direction", and a direction opposite to the frontward direction may be defined as a "rearward direction". On the other hand, the term "radial direction" may refer to a direction perpendicular to the direction in which the piston 130 is reciprocated, that is, a vertical direction in FIG. 1.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant may be compressed in the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape which is wound in a predetermined direction and extend in a rounded shape. The loop pipe 165 may be coupled to the discharge outlet 105.

The linear compressor 100 may further include a frame 110. The frame 110 may fix the cylinder 120 and be coupled to the cylinder 120 by a separate coupling member, for example. The frame 110 may be disposed to surround the cylinder 120. That is, the cylinder 120 may be accommodated within the frame 110. The discharge cover 160 may be coupled to a front surface of the frame 110.

At least a portion of the high-pressure gaseous refrigerant discharged through the opened discharge valve 161 may flow toward an outer circumferential surface of the cylinder 120 through a space formed at a portion at which the cylinder 120 and the frame 110 are coupled to each other. The refrigerant may be introduced into the cylinder 120 through a nozzle (see reference numeral 123 of FIG. 7) provided in the cylinder 120. The introduced refrigerant may flow into a space (see reference symbol C1 of FIG. 7) defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 130 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be provided as a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may surround an outside of the permanent magnet 146 to firmly maintain a coupled state between the permanent magnet 146 and the connection member 138. The outer stators 141, 143, and 145 may include coil winding bodies 143 and 145, and stator core 141.

The coil winding bodies 143 and 145 may include a bobbin 143 and a coil 145 wound in a circumferential direction of the bobbin 145. The coil 145 may have a polygonal cross-section, for example, a hexagonal cross-section. The stator core 141 may be manufactured by stacking a plurality of laminations in the circumferential direction and be disposed to surround the coil winding bodies 143 and 145.

A stator cover 149 may be disposed at one side of the outer stators 141, 143, and 145. A first side of the outer stators 141, 143, and 145 may be supported by the frame 110, and a second side of the outer stators 141, 143, and 145 may be supported by the stator cover 149. The inner stator 148 may be fixed to a circumference of the frame 110. Also, in the inner stator 148, a plurality of laminations may be stacked in a circumferential direction outside of the frame 110.

The linear compressor 100 may further include a support 137 to support the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may further include a plurality of springs 176 which are adjustable in natural frequency to allow the piston 130 to perform a resonant motion. The plurality of springs 176 may include a first spring supported between the support 137 and the stator cover 149, and a second spring supported between the support 137 and the back cover 170.

The linear compressor 100 may additionally include plate springs 172 and 174, respectively, disposed on first and second lateral sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 2:
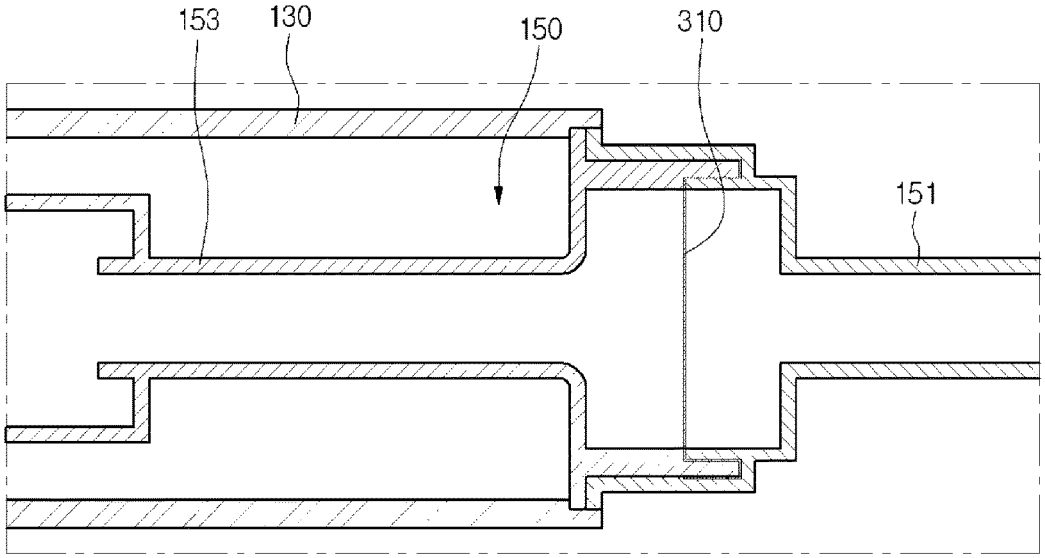
FIG. 2 is a cross-sectional view of a suction muffler of the linear compressor of FIG. 1.

FIG. 2 is a cross-sectional view of a suction muffler of the linear compressor of FIG. 1. Referring to FIG. 2, the suction muffler 150 according to this embodiment may include the first muffler 151, the second muffler 153 coupled to the first muffler 151, and a first filter 310 supported by the first and second mufflers 151 and 153.

A flow space, in which the refrigerant may flow may be defined in each of the first and second mufflers 151 and 153. The first muffler 151 may extend from an inside of the suction inlet 104 in a direction toward the discharge outlet 105, and at least a portion of the first muffler 151 may extend inside of the suction guide 155. The second muffler 153 may extend from the first muffler 151 to inside of the piston body 131.

The first filter 310 may be disposed in the flow space to filter foreign substances. The first filter 310 may be formed of a material having a magnetic property. Thus, foreign substances contained in the refrigerant, in particular, metallic substances, may be easily filtered.

For example, the first filter 310 may be formed of stainless steel, and thus, have a magnetic property to prevent the first filter 310 from rusting. Alternatively, the first filter 310 may be coated with a magnetic material, or a magnet may be attached to a surface of the first filter 310.

The first filter 310 may be a mesh-type structure and have an approximately circular plate shape. Each filter hole of the first filter 310 may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion into which the first and second mufflers 151 and 153 are press-fitted, and then, may be assembled. For example, a groove may be defined in one of the first muffler 151 or the second muffler 153, and a protrusion inserted into the groove may be disposed on the other one of the first muffler 151 or the second muffler 153.

The first filter 310 may be supported by the first and second mufflers 151 and 153 in a state in which both sides of the first filter 310 are disposed between the groove and the protrusion. In the state in which the first filter 310 is disposed between the first and second mufflers 151 and 153, when the first and second mufflers 151 and 153 move in a direction that approach each other, and then, are press-fitted, both sides of the first filter 310 may be inserted and fixed between the groove and the protrusion.

As described above, as the first filter 310 is provided on the suction muffler 150, a foreign substance having a size greater than a predetermined size of the refrigerant suctioned through the suction inlet 104 may be filtered by the first filter 310. Thus, the first filter 310 may filter the foreign substance from the refrigerant acting as the gas bearing between the piston 130 and the cylinder 120 to prevent the foreign substance from being introduced into the cylinder 120. Also, as the first filter 310 is firmly fixed to the portion at which the first and second mufflers 151 and 153 are press-fitted, separation of the first filter 310 from the suction muffler 150 may be prevented.

Figure 4:
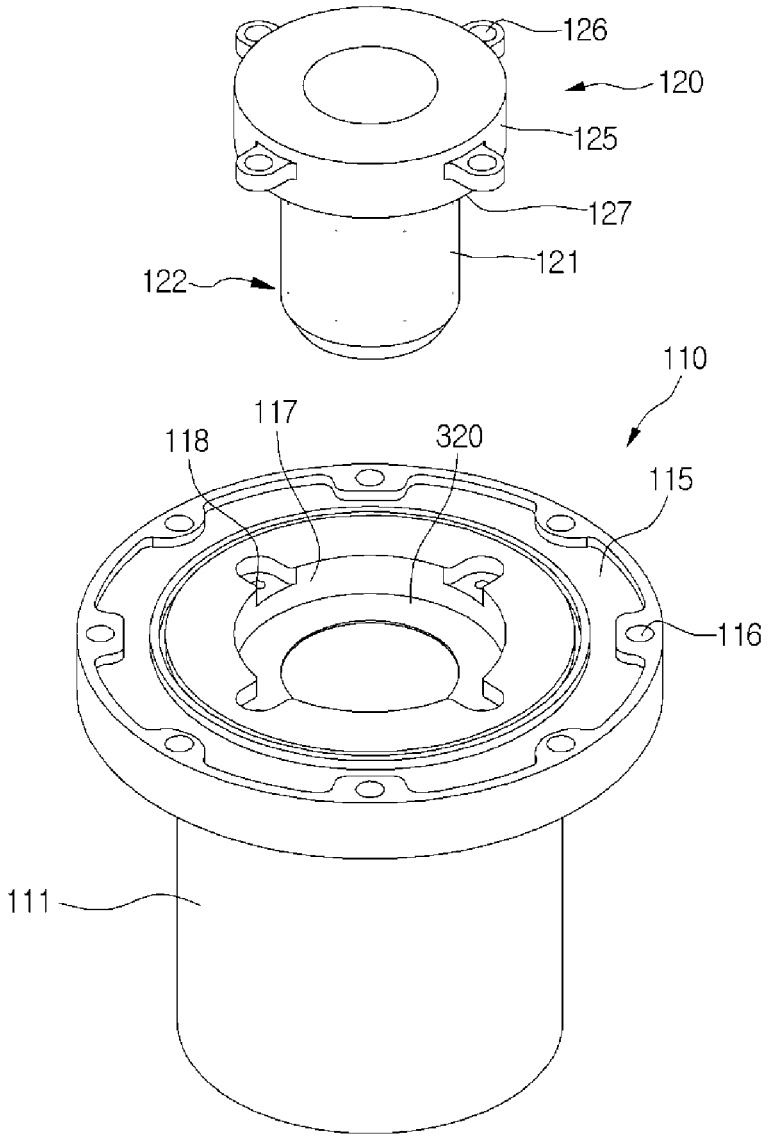
FIG. 4 is an exploded perspective view of a cylinder and a frame of the linear compressor of FIG. 1.

FIG. 3 is a partial cross-sectional view of the linear compressor of FIG. 1, illustrating a position of a second filter. FIG. 4 is an exploded perspective view of a cylinder and a frame of the linear compressor of FIG. 1.

Referring to FIGS. 3 and 4, the linear compressor 100 according to an embodiments may include a second filter 320 disposed between the frame 110 and the cylinder 120 to filter a high-pressure gas refrigerant discharged through the discharge valve 161. The second filter 320 may be disposed on a portion of a coupled surface at which the frame 110 and the cylinder 120 are coupled to each other.

In detail, the cylinder 120 may include a cylinder body 121 having an approximately cylindrical shape, and a cylinder flange 125 that extends from the cylinder body 121 in a radial direction. The cylinder body 121 may include at least one nozzle assembly 122, in which the discharged gas refrigerant may be introduced. The at least one nozzle assembly 122 may be formed in an approximately circular shape along a circumferential surface of the cylinder body 121.

The at least one nozzle assembly 122 may include a plurality of nozzle assemblies. The plurality of nozzle assemblies 122 may include a first assembly 122*a* disposed on a first side with respect to a central portion 121*c* of the cylinder body 121 in an axial direction, a second assembly 122*c* disposed on a second side with respect to the central portion 121*c* of the cylinder body 121 in the axial direction, and a third nozzle assembly 122*b*.

The first to third nozzle assembles 122*a*, 122*b*, and 122*c* may include a plurality of nozzles 123. The plurality of nozzles 123 may be spaced apart from each other and recessed inward from an outer circumferential surface of the cylinder body 121 in the radial direction.

A coupling portion 126 coupled to the frame 110 may be disposed on the cylinder flange 125. The coupling portion 126 may protrude outward from an outer circumferential surface of the cylinder flange 125. The coupling portion 126 may be coupled to a cylinder coupling hole 118 of the frame 110 by a predetermined coupling member, for example.

The cylinder flange 125 may have a seat surface 127 seated on the frame 110. The seat surface 127 may be a rear surface of the cylinder flange 125 that extends from the cylinder body 121 in a radial direction.

The frame 110 may include a frame body 111 that surrounds the cylinder body 121, and a cover coupling portion 115 that extends in a radial direction of the frame body and coupled to the discharge cover 160. The cover coupling portion 115 may have a plurality of cover coupling holes 116, in which the coupling member coupled to the discharge cover 160 may be inserted, and a plurality of the cylinder coupling hole 118, in which the coupling member coupled to the cylinder flange 125 may be inserted. The plurality of cylinder coupling holes 118 may be defined at positions received from the cover coupling portion 115.

The frame 110 may have a recess 117 recessed backward from the cover coupling portion 115 to allow the cylinder flange 125 to be inserted therein. That is, the recess 117 may be disposed to surround an outer circumferential surface of the cylinder flange 125. The recess 117 may have a recessed depth corresponding to a front to rear width of the cylinder flange 125.

A predetermined refrigerant flow space may be defined between an inner circumferential surface of the recess 117 and the outer circumferential surface of the cylinder flange 125. High-pressure gas refrigerant discharged from the discharge valve 161 may flow toward the outer circumferential surface of the cylinder body 121 via the refrigerant flow space. The second filter 320 may be disposed in the refrigerant flow space to filter the refrigerant.

A seat having a stepped portion may be disposed on or at a rear end of the recess 117. The second filter 320 having a ring shape may be seated on the seat.

In the state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 161 from being introduced into the nozzle(s) 123 of the cylinder 120 and be configured to adsorb oil contained in the refrigerant thereon. For example, the second filter 320 may include a felt formed of polyethylene terephthalate (PET) fiber, or an adsorbent paper, for example. The PET fiber may have superior heat-resistance and mechanical strength. A foreign substance having a size of about 2 μm or more, which is contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this way, the refrigerant may be filtered by the second filter 320.

Figure 5:
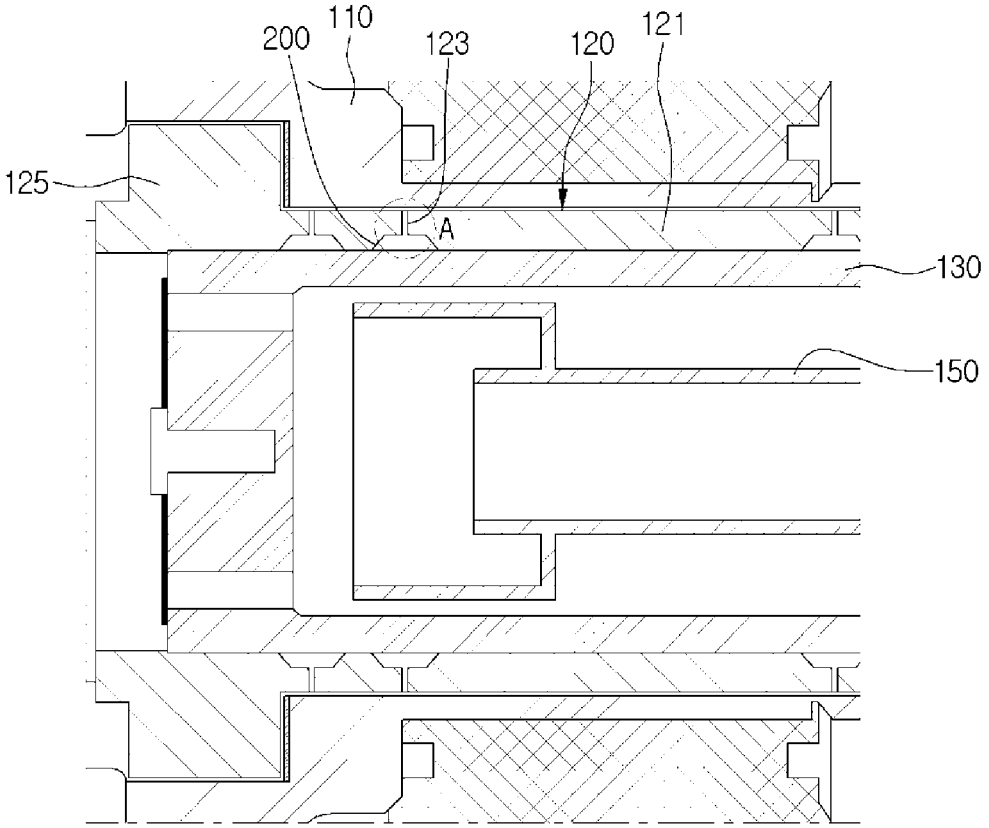
FIG. 5 is a cross-sectional view illustrating a state in which the cylinder of FIG. 4 and a piston are coupled to each other.
Figure 6:
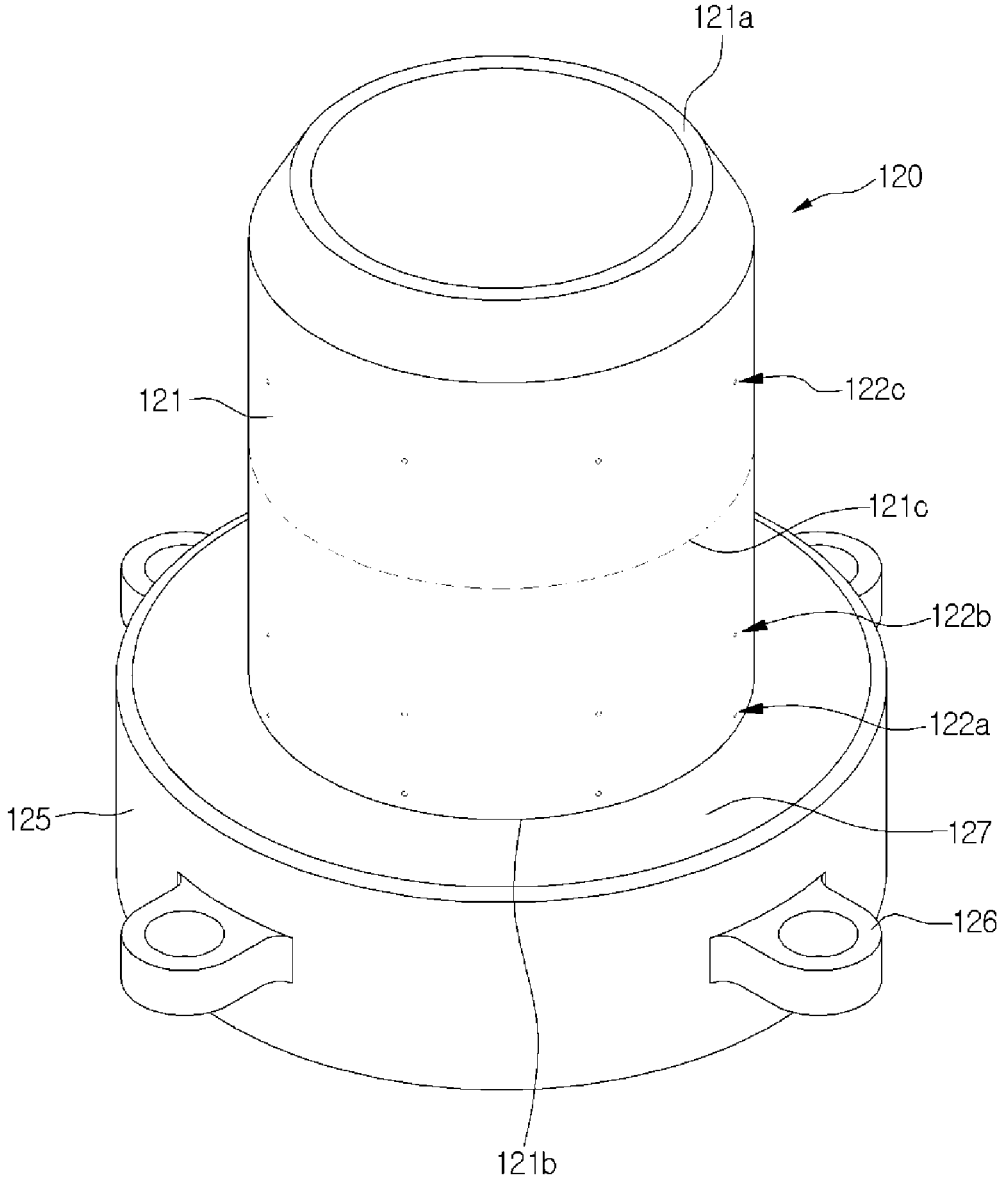
FIG. 6 is an exploded perspective view of the cylinder according to embodiments.
Figure 7:
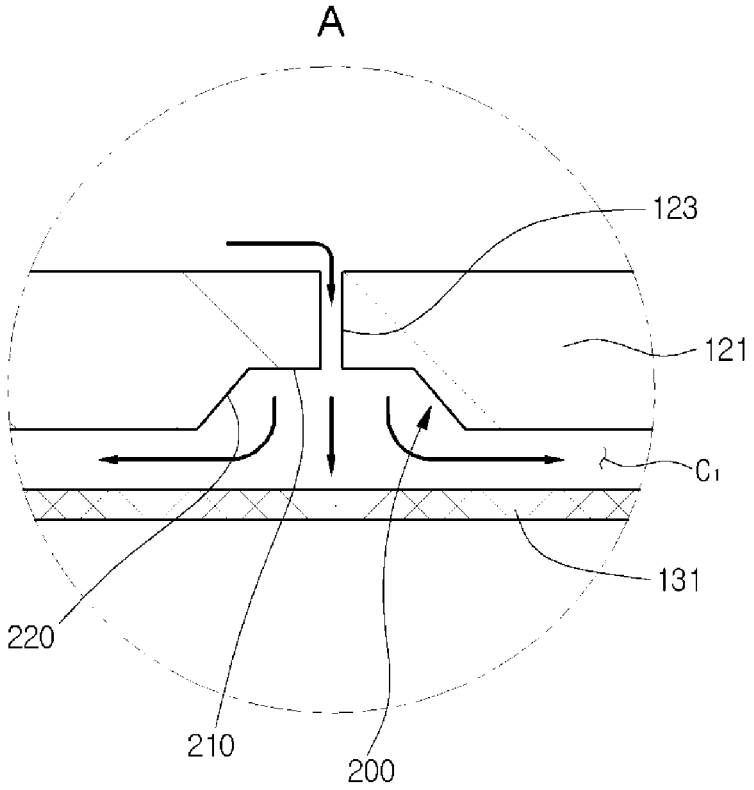
FIGS. 7 and 8 are enlarged cross-sectional views of a portion A of FIG. 5.
Figure 8:
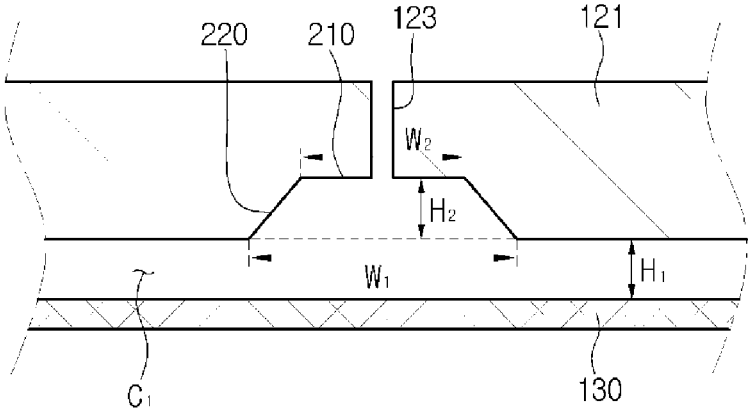
Figure 9:
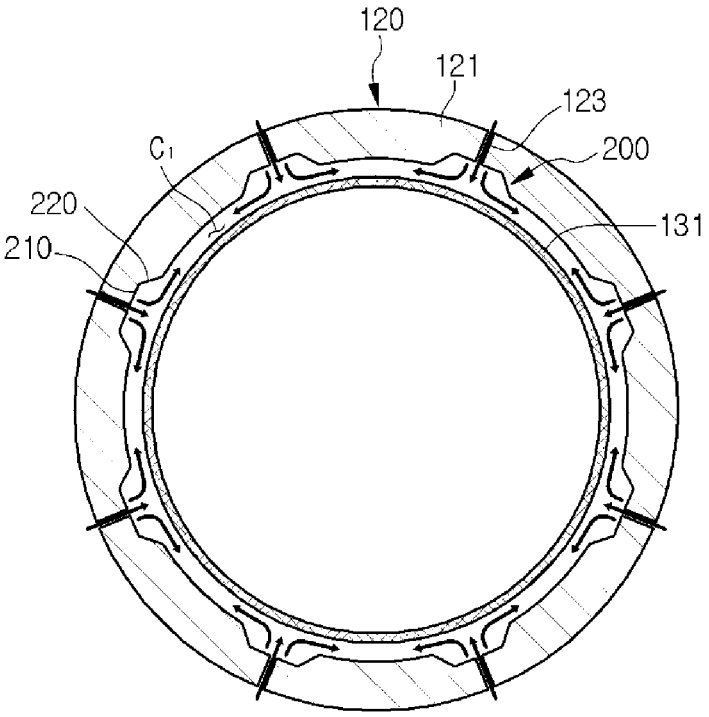
FIG. 9 is a cross-sectional view illustrating an arrangement of the cylinder and the piston according to an embodiment.

FIG. 5 is a cross-sectional view illustrating a state in which the cylinder of FIG. 4 and a piston are coupled to each other. FIG. 6 is an exploded perspective view the cylinder according to embodiments. FIGS. 7 and 8 are enlarged cross-sectional views of a portion A of FIG. 5. FIG. 9 is a cross-sectional view illustrating an arrangement of the cylinder and the piston according to an embodiment.

Referring to FIGS. 5 to 8, the cylinder 120 according to one embodiment may include the cylinder body 121 having an approximately cylindrical shape to form a first body end 121*a* and a second body end 121*b*, and the cylinder flange 125 that extends from the second body end 121*b* of the cylinder body 121 in a radial direction. The first body end 121*a* and the second body end 121*b* form both ends of the cylinder body 121 with respect to a central portion 121*c* of the cylinder body 121 in an axial direction.

The cylinder body 121 may include a plurality of the nozzle assemblies 122, through which at least a portion of the high-pressure gas refrigerant discharged through the discharge valve 161 may flow. The plurality of nozzle assembles 122 may be disposed to be spaced apart from each other.

The plurality of nozzle assembles 122 may include the first and second assembles 122*a* and 122*b*, which may be both disposed on the first side with respect to the central portion 121*c* in the axial direction of the cylinder body 121, and the third assembly 122*c*, which may be disposed on the second side with respect to the central portion 121*c* in the axial direction. The first to third assembles 122*a*, 122*b*, and 122*c* may include a plurality of the nozzles 123. Each of the plurality of nozzles 123 may be spaced apart from the outer circumferential surface of the cylinder body 121.

Each of the plurality of nozzles 123 may be recessed from the outer circumferential surface of the cylinder body 121 by a predetermined depth and width. The refrigerant may be introduced into the cylinder body 121 through the plurality of nozzles 123.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in the state in which the outer circumferential surface of the piston 130 is spaced apart from the inner circumferential surface of the cylinder 120 by pressure of the introduced refrigerant. That is, the introduced refrigerant may provide a lifting force by which the piston 130 may be lifted from the inner circumferential surface of the cylinder 120.

The first and second nozzle assembles 122*a* and 122*b* may be disposed at positions closer to the second body end 121*b* with respect to the central portion 122*c* in the axial direction of the cylinder body 121, and the third nozzle assembly 122*c* may be disposed at a position closer to the first body end 121*a* with respect to the central portion 121*c* in the axial direction of the cylinder body 121. That is, the plurality of nozzle assembles 122 may be provided in numbers which are not symmetrical to each other with respect to the central portion 121*c* in the axial direction of the cylinder body 121.

Referring to FIG. 6, the cylinder 120 may have a relatively high inner pressure at a side of the second body end 121*b* which is closer to a discharge-side of the compressed refrigerant when compared to that of the first body end 121*a* which is closer to a suction-side of the refrigerant. Thus, more nozzle assemblies 122 may be provided at a side of the second body end 121*b* to enhance a function of the gas bearing, and relatively less nozzle assemblies 122 may be provided at a side of the first body end 121*a*.

Referring to FIG. 7, the cylinder 120 may include the nozzle 123 recessed from the outer circumferential surface of the cylinder body 121 and an expansion portion 200 that extends from the nozzle 123 toward the inner circumferential surface of the cylinder body 121.

The nozzle 123 may be connected to the outer circumferential surface of the cylinder body 121, and the expansion portion 200 may be connected to the inner circumferential surface of the cylinder body 121. A plurality of each of the nozzle 123 and the expansion portion 200 may be provided. The nozzle 123 may have a predetermined refrigerant flow cross-section area and may extend inward from the outer circumferential surface of the cylinder body 121 in the radial direction.

The expansion portion 200 may expand from the nozzle 123 in an axial direction. The expansion portion 200 may have a refrigerant flow cross-section area greater than a refrigerant flow cross-section area of the nozzle 123.

In detail, the extension portion 200 may include a first extension portion 210 that extends from the nozzle 123 in the axial direction, that is, in a front to rear direction, and a second extension portion 220 that extends from the first extension portion 210 toward the inner circumferential surface of the cylinder body 121.

The second extension portion 220 may be inclined with respect to the radial direction of the cylinder 120. On the other hand, an extension direction of the second extension portion 220 may cross the inner circumferential surface of the cylinder body 121.

The space C1, in which the refrigerant introduced through the nozzle 123 and the expansion portion 200 may flow, may be defined between the outer circumferential surface of the piston body 131 and the inner circumferential surface of the cylinder body 121. On the other hand, the piston 130 may be lifted from the inner circumferential surface of the cylinder 120 by the pressure of the refrigerant introduced through the nozzle 123 and the expansion portion 200. A space by which the piston 130 is lifted may be the space C1.

A height of the space C1 in the radial direction may be set to a sufficient height at which the piston 130 may be smoothly movable within the cylinder 120 and also may not be substantially large. For example, the space C1 may have a height H1 ranging from about 2 μm to about 12 μm.

The refrigerant passing through the cylinder 120 may have a flow cross-section area that gradually increases from the nozzle 123 toward the expansion portion 200. Thus, the refrigerant passing through the nozzle 123 may flow into the space C1 without causing a pressure loss while passing through the expansion portion 200.

If the expansion portion 200 is not provided, as the refrigerant passing through the nozzle 123 is directly introduced into the space C1, which is a relatively narrow space, a significant pressure drop may occur. As a result, as the refrigerant having a pressure significantly less than the discharge pressure is introduced, a sufficient lifting force may not be provided to the piston 130.

The expansion portion 200 may provide a space in which burrs generated when the nozzle 123 is processed may be received. That is, the expansion portion 200 may be a groove recessed from the inner circumferential surface of the cylinder body 121 toward the outside of the cylinder 120. That is, the expansion portion 200 may be understood as a "receiving portion" to receive the burrs.

The expansion portion 200 may restrict an effect of the burrs with respect to the piston 130. That is, the expansion portion 200 may be understood as an "interference prevention groove" recessed from the inner circumferential surface of the cylinder body 121 to prevent the cylinder 120 and the piston 130 from interfering with each other.

The expansion portion 200 may have a cone shape, a tip of which may be cut. In FIG. 8, a width W1 of a lower end of the expansion portion 200 in the axial direction may be greater than a width W2 of an upper end of the expansion portion 200 in the axial direction. Thus, a flow cross-section area of the expansion portion 200 may gradually increase with respect to the flow direction of the refrigerant. For example, the width W1 of the lower end of the expansion portion 200 in the axial direction may be about 1 mm, and the width W2 of the upper end of an expansion portion 200 in the axial direction may be about 1.5 mm.

A height H2 of the expansion portion 200 in the radial direction and the height H1 of the space C1 in the radial direction may be expressed as following equation formula:

$$0.5*H1<H2<4*C1$$

where, H2 may be equal to or greater than H1. As H2 may be greater than H1, an internal volume of the expansion portion 200 may be relatively larger than an internal volume of the space C1 around the expansion portion 200. Thus, the piston 130 may be sufficiently lifted by the pressure of the refrigerant that exists in the expansion portion 200.

Figure 10A:
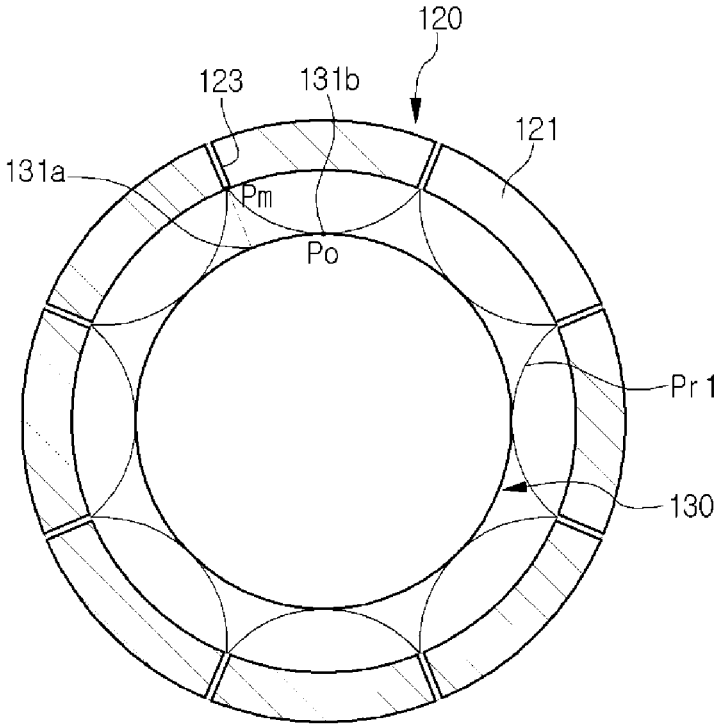
FIG. 10A is a view illustrating pressure distribution within the cylinder when the expansion portion is not provided.
Figure 10B:
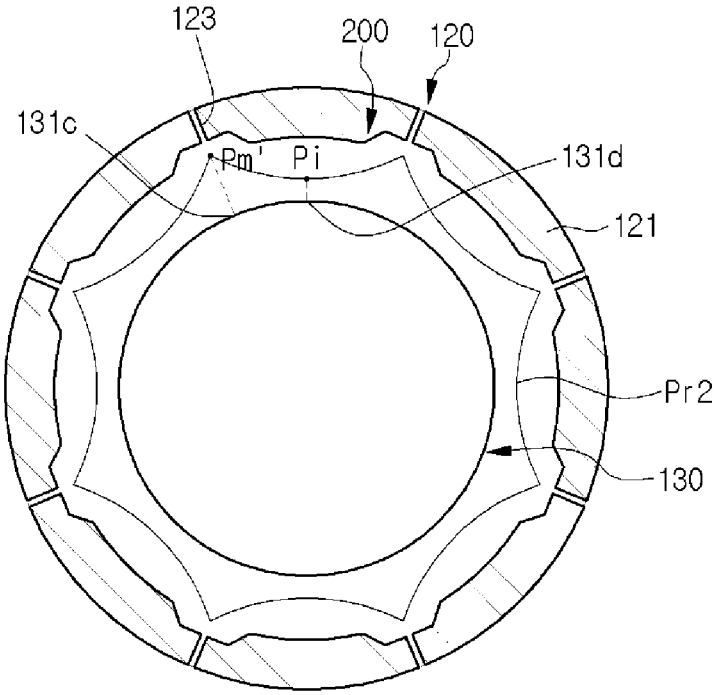
FIG. 10B is a view illustrating pressure distribution within the cylinder when the expansion portion is provided according to embodiments.

FIG. 10A is a view illustrating pressure distribution within the cylinder when the expansion portion is not provided. FIG. 10B is a view illustrating pressure distribution within the cylinder when the expansion portion is provided according to embodiments.

Unlike this embodiment, FIG. 10A illustrates a pressure distribution Pr1 when the nozzle 123 is provided in the cylinder body 121, that is, when the nozzle portion 123 extends from the outer circumferential surface to the inner circumferential surface of the cylinder body 121. In the pressure distribution Pr1, it is seen that the pressure gradually increases outward in a radial direction.

Referring to FIG. 10A, refrigerant is introduced into the cylinder 120 through the nozzle 123. The refrigerant may be reduced in pressure, and thus, the refrigerant having a relatively low pressure may be applied to the piston 130. Referring to the pressure distribution of the refrigerant, a relatively high pressure Pm may be generated at an outlet-side of the nozzle 123. That is, when the nozzle 123 extends inward from the cylinder 120, the pressure Pm may be applied at a first point 131*a*, at which the nozzle 123 meets the piston 130. On the other hand, a relatively low pressure Po may be applied at a point spaced somewhat from the outlet-side of the nozzle 123, that is, a second point 131*b* of the piston 130 that corresponds to an approximately central point of two adjacent nozzles.

As a result, a non-uniform pressure may be applied to the outer circumferential surface of the piston body 131. Thus, stable lifting of the piston 130 from the inner circumferential surface of the cylinder 120 may not be accomplished. For example, the piston 130 may lean in one direction from an inner center of the cylinder 120 to cause interference between the piston 130 and the cylinder 120.

FIG. 10B illustrates a pressure distribution Pr2 when the nozzle 123 and the expansion portion 200 are provided in the cylinder body 121 according to embodiments. In the pressure distribution Pr2, it is seen that pressure gradually increases outward in a radial direction.

Referring to FIG. 10A, refrigerant is introduced into the cylinder 120 via the nozzle 123 and the expansion portion 200. The pressure loss of the refrigerant may be reduced. Thus, refrigerant having a pressure slightly different from the discharge pressure may be applied to the piston 130.

Referring to the pressure distribution, a relatively high pressure Pm' may be generated at an outlet-side of the expansion portion 200. The pressure Pm' may be somewhat higher than the pressure Pm described in FIG. 10A.

The pressure Pm' may be applied to a first point 131*c* of the piston 130 corresponding to a position of the nozzle 123. A relatively low pressure Pi may be applied to a point spaced somewhat from the outlet-side of the nozzle 123, that is, a second point 131*d* of the piston 130 that corresponds to an approximately central point of two adjacent nozzles.

The pressure Pi may be higher somewhat than the pressure Po described in FIG. 10A. That is, the refrigerant having sufficient pressure may flow along the inner circumferential surface of the cylinder body 121. Thus, the refrigerant having high pressure may be applied to the point spaced somewhat from the expansion portion 200. As a result, a uniform pressure may be applied to the outer circumferential surface of the piston body 131. Thus, the piston 130 may be stably lifted from the inner circumferential surface of the cylinder 120. Thus, the piston 130 may stably move in the axial direction along the inner center of the cylinder 120.

Figure 11:
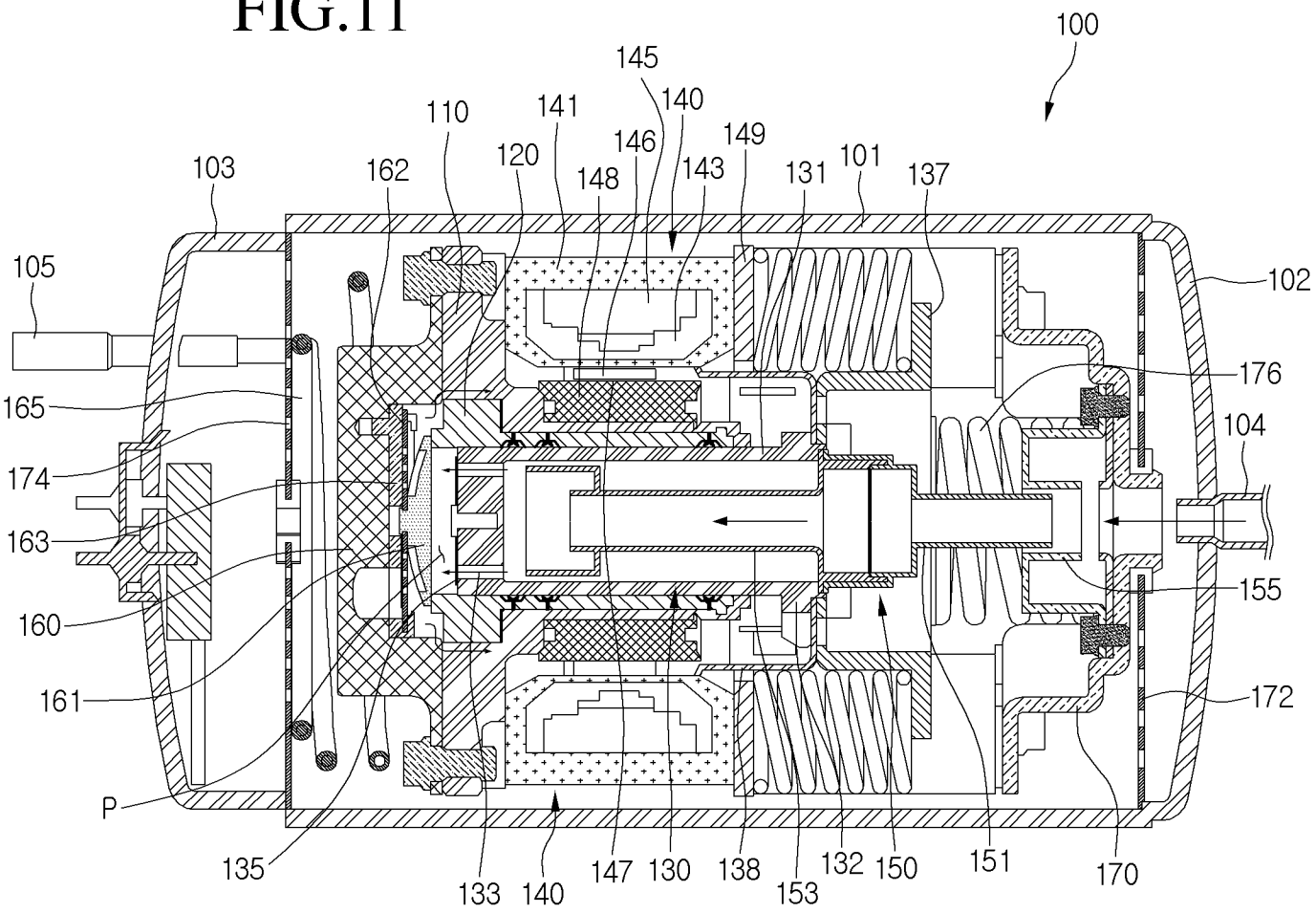
FIG. 11 is a cross-sectional view illustrating refrigerant flow in the linear compressor of FIG. 1.

FIG. 11 is a cross-sectional view illustrating refrigerant flow in the linear compressor of FIG. 1. Referring to FIG. 11, refrigerant flow in the linear compressor according to embodiments will be described hereinbelow.

Referring to FIG. 11, the refrigerant may be introduced into the shell 101 through the suction inlet 104 and flow into the suction muffler 150 through the suction guide 155. The refrigerant may be introduced into the second muffler 153 via the first muffler 151 of the suction muffler 150 to flow into the piston 130. In this process, suction noise of the refrigerant may be reduced.

A foreign substance having a predetermined size (about 25 μm) or more, which is contained in the refrigerant, may be filtered while passing through the first filter 310 provided in the suction muffler 150. The refrigerant within the piston 130 after passing though the suction muffler 150 may be suctioned into the compression space P through the suction hole 133 when the suction valve 135 is open.

When the refrigerant pressure in the compression space P is above the predetermined discharge pressure, the discharge valve 161 may be opened. Thus, the refrigerant may be discharged into the discharge space of the discharge cover 160 through the open discharge valve 161, flow into the discharge outlet 105 through the loop pipe 165 coupled to the discharge cover 160, and be discharged outside of the compressor 100.

At least a portion of the refrigerant within the discharge space of the discharge cover 160 may flow toward the outer circumferential surface of the cylinder body 121 via the space defined between the cylinder 120 and the frame 110, that is, the inner circumferential surface of the recess 117 of the frame 110 and the outer circumferential surface of the cylinder flange 125 of the cylinder 120. The refrigerant may pass through the second filter 320 disposed between the seat surface 127 of the cylinder flange 125 and the seat 113 of the frame 110. In this way, a foreign substance having a predetermined size (about 2 μm) or more may be filtered. Also, oil of the refrigerant may be adsorbed onto or into the second filter 320.

The refrigerant passing through the second filter 320 may be introduced into the plurality of nozzles 123 defined in the outer circumferential surface of the cylinder body 121. The refrigerant may be introduced into the expansion portion 200 via the plurality of nozzles 123. In this way, pressure loss may be reduced.

The refrigerant may flow toward the inner circumferential surface of the cylinder 120 through the expansion portion 200, and the pressure of the refrigerant may be uniformly applied over the outer circumferential surface of the piston 130. Thus, the piston 130 may be stably lifted within the cylinder 120 to perform the reciprocating motion and also prevent friction with the cylinder 120.

In summary, the high-pressure gas refrigerant may be bypassed within the cylinder 120 to serve as the gas bearing with respect to the piston 130 which is reciprocated, thereby reducing abrasion between the piston 130 and the cylinder 120. Also, as oil is not used for the bearing, friction loss due to the oil may not occur even though the compressor 100 operates at a high rate (about 100 Hz).

Also, as the plurality of filters are provided in a passage of the refrigerant flowing in the compressor 100, foreign substances contained in the refrigerant may be removed. Thus, the refrigerant acting as the gas bearing may be improved in reliability. Thus, it may prevent the piston 130 or the cylinder 120 from being worn by the foreign substances contained in the refrigerant. Also, as the oil contained in the refrigerant is removed by the plurality of filters, it may prevent friction loss due to the oil from occurring.

Figure 12:
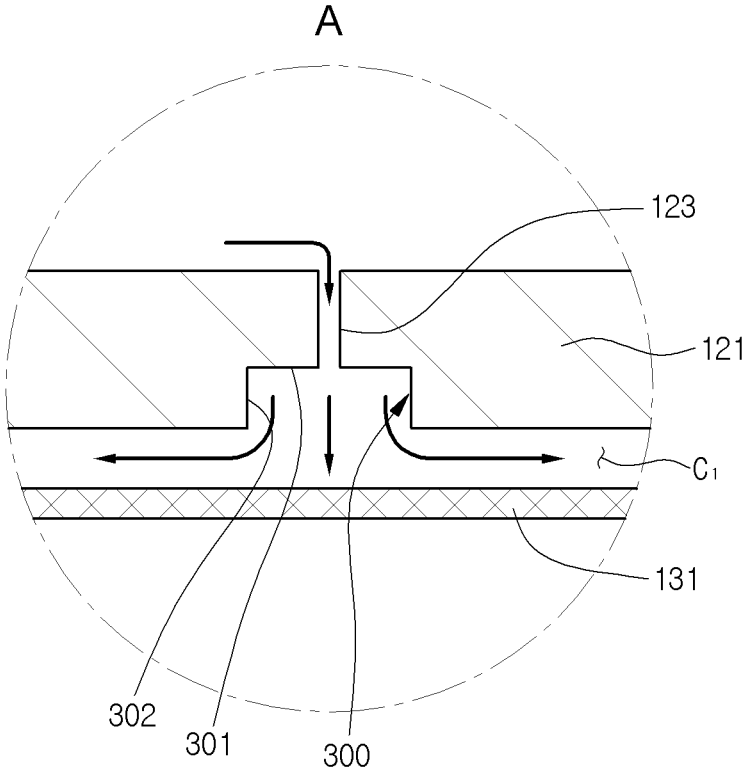
FIG. 12 is a view of a nozzle and an expansion portion according to another embodiment.

FIG. 12 is a view of a nozzle and an expansion portion according to another embodiment. Referring to FIG. 12, an expansion portion 300 according to this embodiment may include a first extension portion 301 that extends from the outlet-side of the nozzle 123 in an axial direction, that is, front and rear directions, and a second extension portion 302 that extends inward from the first extension portion 301 in a radial direction.

Due to the first and second extension portions 301 and 302, the expansion portion 300 may have an approximately cylindrical shape. Also, the expansion portion 300 may have a flow cross-section area greater than a flow cross-section area of the nozzle 123. Further, as the second extension portion 302 extends from the first extension portion 301 in an approximately vertical direction, the flow cross-section area of the expansion portion 300 may be approximately uniform with respect to a flow direction of the refrigerant. As described above, as the expansion portion 300 is provided in the cylinder body 121, sufficient lifting force may be provided to the piston 130 to prevent the cylinder 120 and the piston 130 from interfering with each other.

Figure 13:
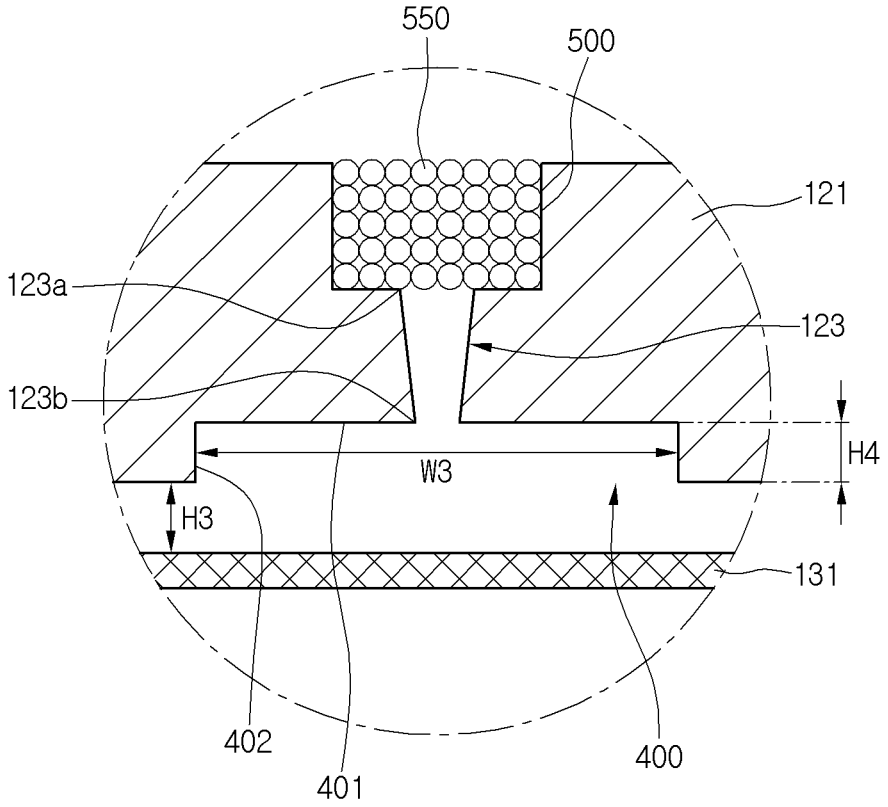
FIG. 13 is a view of a cylinder according to another embodiment.

FIG. 13 is a view illustrating a cylinder according to another embodiment. Referring to FIG. 13, cylinder body 121 according to this embodiment may include a gas inflow 500, through which a gas refrigerant discharged through discharge valve 161 may be introduced, and a third filter 550 that serves as a "filter member" disposed on or in the gas inflow 500. The gas inflow 500 may be recessed in an approximately circular shape along a circumferential surface of the cylinder body 121.

The third filter 550 may prevent a foreign substance having a predetermined size or more from being introduced into cylinder 120 and perform a function to absorb oil contained in the refrigerant. The predetermined size may be about 1 μm.

The third filter 550 may include a thread wound around the gas inflow 500. The thread may be formed of a polyethylene terephthalate (PET) material and have a predetermined thickness or diameter.

The thickness or diameter of the thread may be determined to have adequate dimensions in consideration of rigidity of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow 500 when the thread is wound.

For example, the thickness or diameter of the thread may have several hundreds μm. The thread may be manufactured by coupling a plurality of strands of a spun thread having several tens μm to each other, for example.

The thread may be wound several times, and an end of the thread may be fixed by a knot. The wound number of thread may be adequately selected in consideration of a pressure drop of the gas refrigerant, and a filtering effect with respect to foreign substances. If the wound number of thread is too large, the pressure drop of the gas refrigerant may increase. On the other hand, if the wound number of thread is too small, the filtering effect with respect to the foreign substances may be reduced.

A tension force of the wound thread may be adequately controlled in consideration of a strain of the cylinder and fixation of the thread. If the tension force is too large, deformation of the cylinder 120 may occur. On the other hand, if the tension force is too small, the thread may not be well fixed to the gas inflow 500.

The cylinder body 121 may further include nozzle 123 that extends inward from the gas inflow 500 in a radial direction. The refrigerant may pass through the nozzle 123 after passing through the gas inflow 500, and then, may be introduced into the cylinder body 121.

The nozzle 123 may have a diameter or size less than a diameter or size of the gas inflow 500. Also, the nozzle 123 may have a diameter or size less than a diameter or size of an expansion portion 400.

The nozzle 123 may include a nozzle inlet **123*a* connected to the gas inflow 500, and a nozzle outlet 123*b* connected to the expansion portion 400. The nozzle outlet 123*b* may have a diameter or size less than a diameter or size of the nozzle inlet 123*a*. In the flow direction of the refrigerant, a flow cross-section area of the nozzle 123 may gradually decrease from the nozzle inlet 123*a* to the nozzle outlet 123*b*. In detail, if the diameter of the nozzle 123 is too small, an amount of refrigerant, which may be introduced through the nozzle 123, of the high-pressure gas refrigerant discharged through the discharge valve 161 may be too large to increase flow loss in the compressor. On the other hand, if the diameter of the nozzle 123 is too small, the pressure drop in the nozzle 123** may increase, reducing performance as a gas bearing.

Thus, in this embodiment, the nozzle inlet **123*a* of the nozzle 123 may have a relatively large diameter to reduce the pressure drop of the refrigerant introduced into the nozzle 123. In addition, the nozzle outlet 123*b* may have a relatively small diameter to control an inflow amount of gas bearing through the nozzle 123** to a predetermined value or less.

The expansion portion 400 may include a first extension portion 401 that extends from the outlet-side of the nozzle 123 in an axial direction, that is, front and rear directions, and a second extension portion 402 that extends inward from the first extension portion 401 in a radial direction.

The second extension portion 402 may have a height H4 greater than a distance H3 between the inner circumferential surface of the cylinder body 121 and the outer circumferential surface of piston body 131. For example, the distance H3 may be about 5 μm, and the height H4 may be about 10 μm. Also, the expansion portion 400 may have a width W3 of about 2 mm in an axial direction thereof.

According to the above-described components, the refrigerant may be filtered by the third filter 550 before being introduced into the nozzle 123 and the expansion portion 400 to prevent foreign substances from acting on the gas bearing between the cylinder 120 and a piston 130.

According to embodiments, the compressor including the inner components may decrease in size to reduce a volume of a machine room of a refrigerator and increase an inner storage space of the refrigerator. Also, the drive frequency of the compressor may increase to prevent performance of the inner portion from being deteriorated due to decreasing size thereof. In addition, as the gas bearing may be applied between the cylinder and the piston, friction force occurring due to the oil may be reduced.

Further, as the nozzle in which the refrigerant for the gas bearing is introduced and the expansion portion extended in flow cross-section area are provided, a lifting force of the piston may be improved by the gas bearing. Furthermore, as the expansion portion is provided, a phenomenon in which burrs generated when the nozzle is processed causing abrasion may be prevented.

Also, as the plurality of filtering device may be provided in the compressor, foreign substances or oil contained in the compression gas (or discharge gas) introduced to the outside of the piston from the nozzle of the cylinder may be prevented from being introduced. More particularly, the first filter may be provided on the suction muffler to prevent the foreign substances contained in the refrigerant from being introduced into the compression chamber. Also, the second filter may be provided on the coupling portion between the cylinder and the frame to prevent foreign substances and oil contained in the compressed refrigerant gas from flowing into the gas inflow of the cylinder.

As described above, as foreign substances or oil contained in the compressed refrigerant that acts as the gas bearing in the compressor may be filtered through the plurality of filtering devices, it may prevent the nozzle of the cylinder from being blocked by the foreign substances or oil. As the blocking of the nozzle of the cylinder is prevented, the gas bearing effect may be effectively performed between the cylinder and the piston, and thus, abrasion of the cylinder and the piston may be prevented.

Embodiments disclosed herein provide a linear compressor in which a gas bearing may easily operate between a cylinder and a piston.

Embodiments disclosed herein provide a linear compressor that may include a shell including a suction inlet; a cylinder provided in the shell to define a compression space for a refrigerant; a piston reciprocated in an axial direction within the cylinder; a discharge valve provided on or at one side of the cylinder to selectively discharge the refrigerant compressed in the compression space for the refrigerant; a nozzle part or nozzle, through which at least a portion of the refrigerant discharged through the discharge valve may flow, the nozzle part being disposed in the cylinder; and an expansion part or portion that extends from the nozzle part to an inner circumferential surface of the cylinder, the expansion part having a flow cross-section area greater than that of the nozzle part. The expansion part may be recessed outward from the inner circumferential surface of the cylinder.

The nozzle part may be connected to an outer circumferential surface of the cylinder, and the expansion part may be connected to the inner circumferential surface of the cylinder. The expansion part may have the flow cross-section area that gradually increases with respect to a flow direction of the refrigerant.

The expansion part may include a first extension part or portion that extends from the nozzle part in the axial direction, and a second extension part or portion that extends from the first extension part in a direction that crosses an outer circumferential surface of the piston. The second extension part may be inclined with respect to a radius direction of the cylinder. The expansion part may have a cone shape, a tip of which may be cut.

The second extension part may extend in a radius direction of the cylinder. The expansion part may have a width (W2) in the axial direction, and a height (H2) in a radial direction. The height (H2) of the expansion part in the radial direction may be equal to or greater than a height (H1) of a spaced space (C1) between the cylinder and the piston in the radius direction.

The nozzle part may extend inward from an outer circumferential surface of the cylinder in a radial direction of the cylinder. Each of the nozzle part and the expansion part may be provided in plurality.

The linear compressor may further include a gas inflow part or inflow recessed from an outer circumferential surface of the cylinder, and a thread filter disposed on or in the gas inflow part. The nozzle part may extend from the gas inflow part toward the inner circumferential surface of the cylinder.

Embodiments disclosed herein further provide a linear compressor that includes a shell including a suction inlet; a cylinder provided in the shell to define a compression space for a refrigerant; a piston reciprocated in an axial direction within the cylinder; a discharge valve provided on or at a side of the cylinder to selectively discharge the refrigerant compressed in the compression space for the refrigerant; a nozzle part or nozzle recessed from an outer circumferential surface of the cylinder to introduce at least a portion of the refrigerant discharged from the discharge valve; and a groove that communicates with the nozzle part, the groove being recessed from an inner circumferential surface of the cylinder to prevent the cylinder and the piston from interfering with each other. The refrigerant discharged form the discharge valve may be introduced into the groove via the nozzle part, and the groove may have a flow cross-section area greater than that of the nozzle part.

A height (H2) of the groove in a radial direction may be greater than one-half of a height (H1) between an outer circumferential surface of the piston and the inner circumferential surface of the cylinder in a radial direction. The height (H2) of the groove in the radial direction may be less than four times of the height (H1) between the outer circumferential surface of the piston and the inner circumferential surface of the cylinder in the radius direction.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising: a shell comprising a suction inlet; a cylinder provided in the shell to define a compression space for a refrigerant, the cylinder including a cylinder body that extends in an axial direction and has a cylindrical shape and a cylinder flange that extends from the cylinder body in a radial direction; a piston reciprocated in the axial direction within the cylinder body; a discharge cover provided at one end of the cylinder and having a discharge space for the refrigerant discharged from the compression space; a discharge valve provided at the discharge cover to selectively discharge refrigerant compressed in the compression space; a frame disposed to surround the cylinder body and the cylinder flange; a gas flow path formed between an outermost circumferential surface of the cylinder flange and an innermost circumferential surface of the frame; a gas inflow recessed in a circular shape along an outer circumferential surface of the cylinder body, the gas inflow being configured to be fluidly connected to the gas flow path; a thread filter disposed to be wound around the gas inflow and comprising a plurality of strands of a spun thread; a plurality of nozzles recessed inward from the gas inflow in the radial direction; and an expansion portion that extends from each of the plurality of nozzles towards an inner circumferential surface of the cylinder body, the expansion portion being fluidly connected with the plurality of nozzles and having an axial width greater than an axial width of each of the plurality of nozzles, wherein the gas inflow, each of the plurality of nozzles, and the expansion portion are arranged in the radial direction, wherein the frame includes: a frame body that surrounds the cylinder body; a frame flange that extends in the radial direction of the frame body and coupled to the discharge cover; and a recess recessed from the frame flange to allow the cylinder flange to be inserted therein, and wherein the gas flow path comprises a first path extending in the axial direction and a second path extending in the radial direction.

2. The linear compressor according to claim 1, wherein the expansion portion is recessed outward from the inner circumferential surface of the cylinder body.

3. The linear compressor according to claim 1, wherein the expansion portion comprises:

a first extension portion that extends from each of the plurality of nozzles in the axial direction; and a second extension portion that extends from the first extension portion in a direction that crosses an outer circumferential surface of the piston.

4. The linear compressor according to claim 3, wherein the second extension portion extends in a direction perpendicular to the first extension portion.

5. The linear compressor according to claim 1, wherein a height of the expansion portion in the radial direction is equal to or greater than a height of a space between the cylinder and the piston in the radial direction.

6. The linear compressor according to claim 1, wherein the expansion portion has a cross-sectional area greater than a cross-sectional area of each of the plurality of nozzles.

7. The linear compressor according to claim 1, wherein the gas inflow has an axial width greater than an axial width of each of the plurality of nozzles.

8. The linear compressor according to claim 1, wherein the expansion portion has an axial width greater than an axial width of the gas inflow.

9. The linear compressor according to claim 1, wherein the cylinder further includes a radial flange arranged to protrude from the cylinder flange.

10. The linear compressor according to claim 9, wherein the frame further includes a coupling hole formed at the recess, the coupling hole being coupled with the radial flange.

* * * * *